US006315157B1

(12) United States Patent
Halliburton

(10) Patent No.: US 6,315,157 B1
(45) Date of Patent: Nov. 13, 2001

(54) GRID SKILL AMUSEMENT GAME OR DISPENSING DEVICE

(75) Inventor: Ronald D. Halliburton, Delray Beach, FL (US)

(73) Assignee: Benchmark Entertainment LC, Hypoluxo, FL (US)

( * ) Notice: Subject to any disclaimer, the term of this patent is extended or adjusted under 35 U.S.C. 154(b) by 0 days.

(21) Appl. No.: 09/321,578

(22) Filed: May 28, 1999

Related U.S. Application Data

(60) Provisional application No. 60/087,805, filed on Jun. 3, 1998.

(51) Int. Cl.[7] ..... G07F 11/00

(52) U.S. Cl. ..... 221/87; 221/88; 221/123; 221/133

(58) Field of Search ..... 221/87, 88, 123, 221/133; 273/448

(56) References Cited

U.S. PATENT DOCUMENTS 5,139,384 * 8/1992 Tuttobene ..... 221/88 X
5,558,340 * 9/1996 Ibe et al. ..... 221/87 X

* cited by examiner

*Primary Examiner*—David H. Bollinger
(74) *Attorney, Agent, or Firm*—Andrew C. Aitken; Venable, Baetjer, Howard & Civiletti LLP

(57) ABSTRACT

A coin operated device for the distribution of items includes a target array of tubular members containing items. A ram attached to and extending from a support member. The support member providing for movement of the ram within a plane. The ram is employed to force the items from the selected tubular member of the target array.

17 Claims, 10 Drawing Sheets

GRID SKILL AMUSEMENT GAME OR DISPENSING DEVICE

RELATED APPLICATIONS

This is a continuation in part of the provisional application U.S. No. 60/087,805 filed on Jun. 3, 1998. The present invention relates to a coin actuated device which can be adapted to either serve either as an amusement device controlled by the skill of the operator or as a device used to vend objects. In either embodiment the device can dispense a wide range of objects such as toys, novelties, or food.

BACKGROUND OF THE INVENTION

There are numerous coin actuated devices which are designed to dispense prizes or goods and wide variety of structures. One class of device related to the present invention is referred to in the coin operated amusement industry as a crane. Cranes require the exercise of skill on behalf of the operator to maneuver a capturing device, such as a bucket or claw which is suspended on a chain or cable over a playing field which has been filled with prizes. The operator can control the positioning of the bucket above a playing field along two axises positioned in a plane displaced parallel with respect to the playing field. When the desired position of the bucket has been selected by the operator with respect to the playing filed, a switch is activated to lower the capturing device from the chain or cable toward the playing surface until it comes into contact with either prizes or the bottom surface of the field. In response to a signal that downward movement has been impeded, the sides of the bucket close, typically in a clamshell type arrangement. In an alternative embodiment, a claw is employed which is made up of a plurality of arms which are suspended by a chain or line. After the operator selects the location, the claw is lowered with the arms in an open position. When the playing surface is sensed, or after the claw is lowered a predetermined distance, the arms of the claw close inwardly and anything captured is then raised and removed to a dispensing area. Upon closure of the capture device, the motor driving the cable is reversed causing the capture device to move upward and then the capture device is moved away from the playing area to a dispensing area where the prize is released to the operator. In the event a prize is captured by the capturing device, it is carried up and away to a dispensing area where the capture device opens and releases the prizes to an area which can be accessed by the player. The uses of cranes such as described above frequently dispense candy and plush toys and other small prizes which can be suitably grasped by the capturing device.

A disadvantage of conventional cranes as described above is that, despite the exercise of high degree of skill in properly orienting the capturing device over the intended prize, the device often does not result in dispensing a prize. Furthermore, often despite the lack of skill in the operation of the device, a user may nevertheless fortuitously capture a prize. Often the prizes are irregularly shaped and randomly oriented which further contributes to the achievement of unpredictable results. The unpredictable nature of the devices may result in the frustration and dissatisfaction by players. A further disadvantage with conventional cranes is that the nature of the prizes which can be employed in the units may be limited by the physical dimensions of the capturing device or other characteristics which effect the ability of the capturing device to adequately engage the prize.

Another dispensing device relevant to the invention involves a class vending of products or food such as candy or snacks. One successful vending device uses an array of coils on ledges made from stiff wire which resemble extended springs positioned behind a pane of glass. Items which are intended to be dispensed are positioned within the coils and are designated with a unique identification number visible through the glass. Upon payment of a predetermined amount of money, a keyboard having codes corresponding to the position of the wire coils is activated and the operator may select a desired item by the entry of its corresponding code on the keyboard. Upon entry of an identification code, a motor causes the coil corresponding to the code to rotate a predetermined distance which advances the item positioned within the coil forward and out of the coil. The item is dropped off the ledge and into a dispensing area accessible to the operator.

The object of the present invention is to provide a completely new class of device which can be used as either a vending machine or an amusement game which can dispenses items in response to the skill of the operator. A further object of the invention is to provide a device which can dispense a wide variety of diversely shaped items and can dispense tickets. Yet a further object of the game is to provide a new skill amusement game which incorporates a plurality of targets having different degrees of difficulty. Yet a further object of the invention is to provide an appealing skill game which allows for both predictability and control on behalf of the operator.

SUMMARY OF THE INVENTION

According to a first embodiment of the invention, an amusement device is provided which allows an operator to exercise his skill to attempt to align a pusher or ram directly opposite a tubular member which contains a prize. The pusher or ram is attached to a bracket secured to a belt on a horizontal member which can move in response to operator control in a lateral direction along the length of the horizontal member. The horizontal member is attached to belts on opposite vertical members which enable the horizontal bar to travel in a vertical direction in response to operator control. This arrangement allows an operator to position the ram at any location within a plane defined by the horizontal and vertical members. In use, the operator attempts to exercise his skill to directly align the ram in front of an opening of a desired target tubular member from an array of target tubular members. When the operator is satisfied with the location of the ram, or after a predetermined time has elapsed, the ram is driven forward along a third axis toward the tubular member. If an operator has accurately lined the ram up with a target member, the ram will enter the member and push any object contained within the member out the rear. The item falls from the array through a chute to a dispensing area which can be accessed by the operator.

In an alternative embodiment of the device, the positioning of the ram element is programed to correspond with a preselected code entered into the device. Activation of a key board to select the code will activate motors to cause the ram to precisely align itself with the predetermined tubular member and then move forward causing the ram to engage an item contained within a tubular member and to proceed to push the item rearwardly causing it to move completely through the tube and fall into a dispensing area.

DETAILED DESCRIPTION OF THE INVENTION

Figure 1:
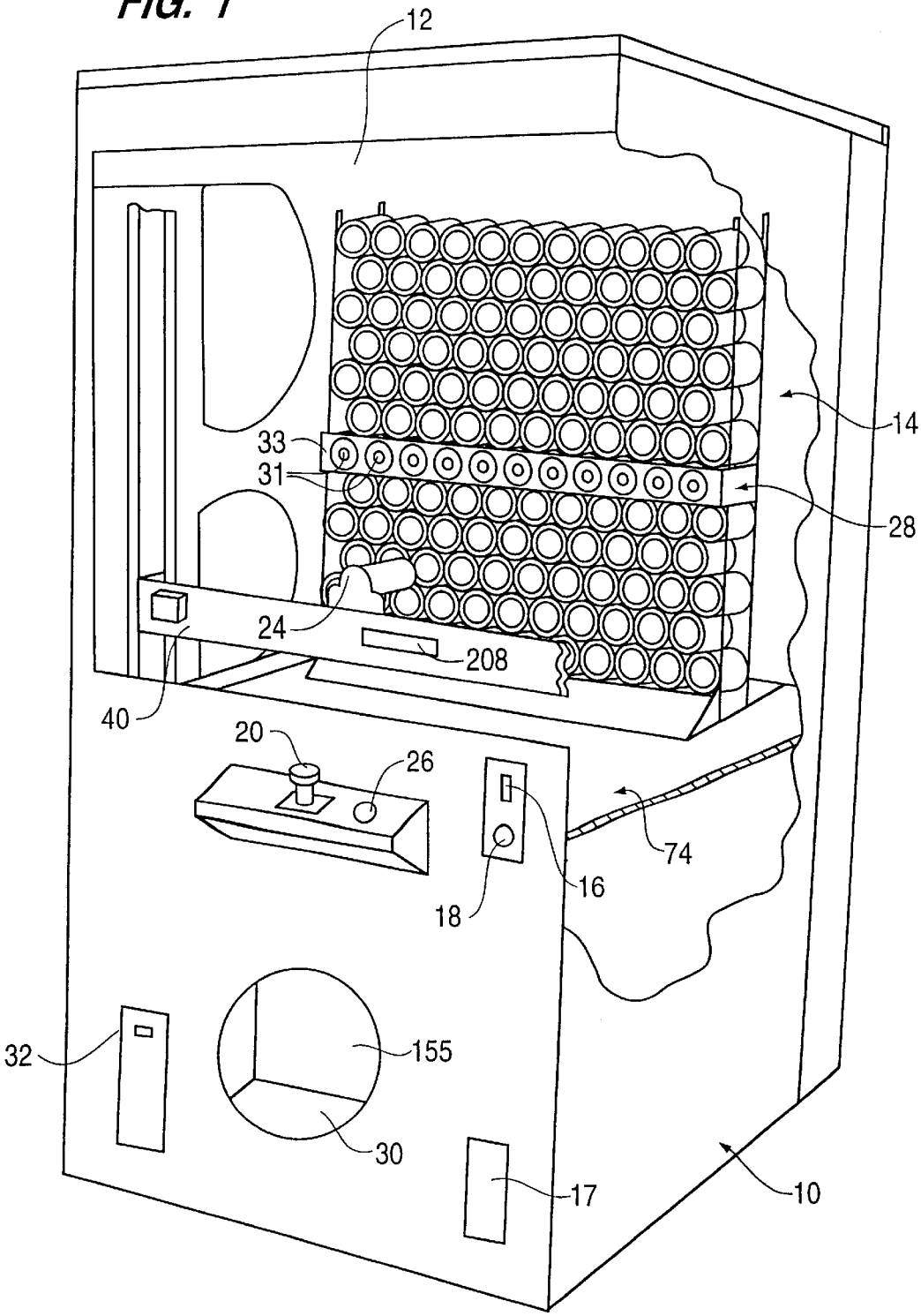
FIG. 1 is a fragmentary perspective view in elevation of a first embodiment of a device according to the invention.

Now referring to FIG. 1, a device according to a first embodiment of the invention consists of a cabinet 10 having a transparent window 12 which enables an operator to view a target array 14 consisting of tubular members stacked upon one another in a series of rows. A row 28 of pressure activated buttons 31 surrounded by annular openings 33 is also provided across the array. Coin slot 16 directs coins or tokens to a conventional coin acceptor (not shown) which detects genuine tokens or coins and rejects spurious coins. In the event a coin is detected, the coin detector generates a signal to the CPU to register the value of the coin. When a predetermined value is present in a register within the CPU, credit button 18 located on the front of the cabinet is activated. Also shown on the front of the cabinet is XY controller 20 which allows the operator to control the activation of stepper motors to position ram 24 into a selected position opposite the target array 14. Adjacent to XY controller 20 is ram drive actuator 26 which under certain conditions, activates a third stepper motor to drive ram 24 from the front of the cabinet toward target array 14. At the bottom of the device there is access to dispensing area 30 which dispenses items to the operator. In the embodiment depicted in FIG. 1 ticket dispenser 32 is provided on the front of the cabinet 10 which can distribute tickets to the in response to activation of target switches 31.

Figure 2:
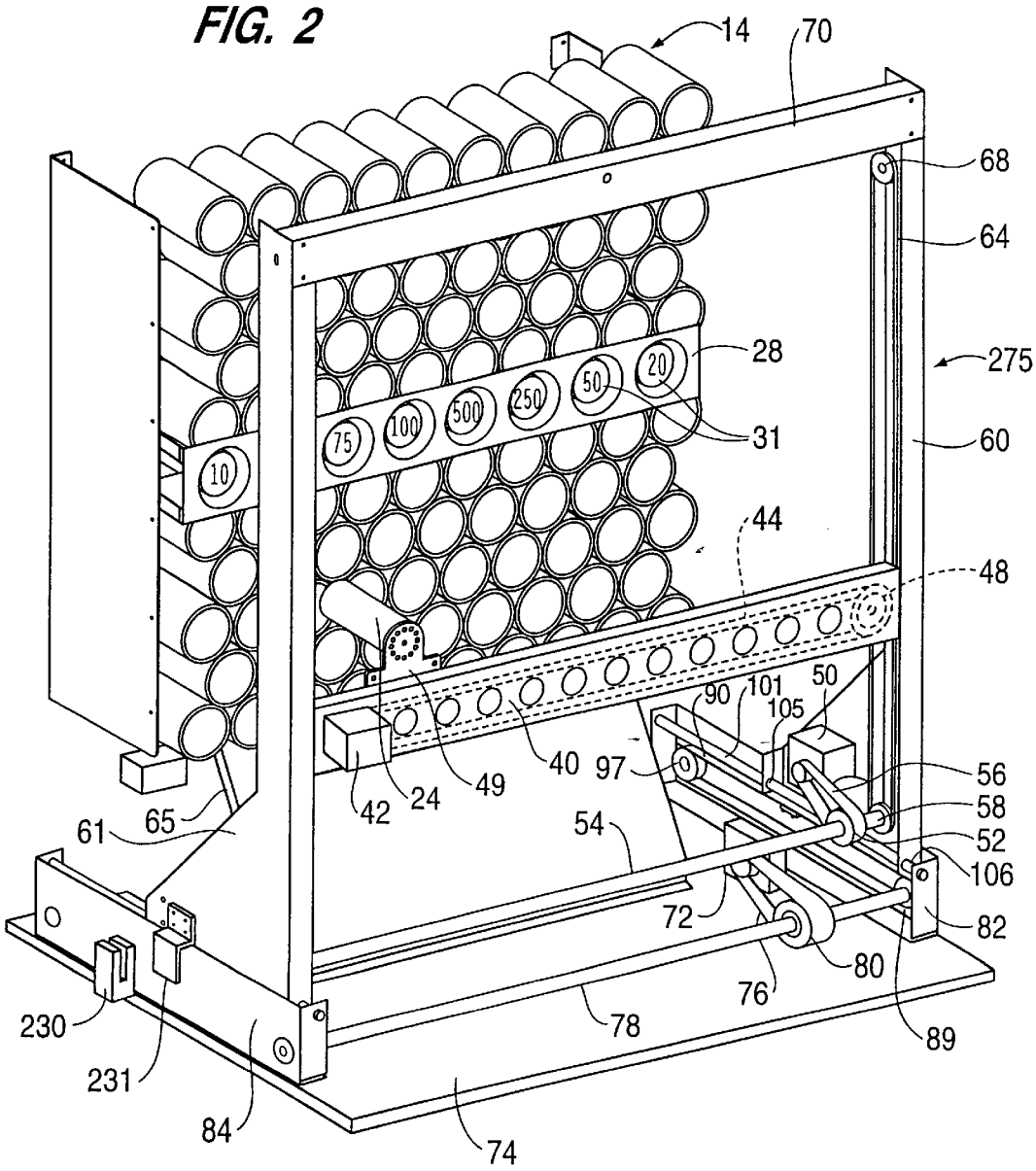
FIG. 2 is a perspective view of the ram element and its drivers and its relationship to the target array according to the first embodiment of the invention.

As best shown in FIG. 2, ram 24 is moved horizontally across the front of the cabinet or, across an "X axis" along transverse member 40 by stepper motor 42. Stepper motor 42 drives a sprocket (not shown) which moves a drive train 44 in the form of an endless belt. An idler sprocket 48 is provided on the end of transverse member 40 opposite the drive sprocket to form a loop. In the preferred embodiment the belt is made of an inelastic material and has extensions or teeth which mesh with opposite extensions provided on the sprockets to prevent slippage. A bracket 49 holds ram 24 and is connected to one side of the loop made by belt 44. Movement of the ram is accordingly affected by rotation of stepper motor 42 which drives belt 44, which in turn moves the bracket 49 holding ram 24. Rollers can be provided on bracket 49 to reduce friction between the bracket and a track provided on transverse member 40. It is contemplated that the ram could be driven in alternative arrangements such as an endless chain which engages teeth on opposite sprockets or other mechanical drive arrangements which can precisely translate the motion of a motor to the ram 24 such as screw gear. The direction and degree of rotation of the stepper motor is precisely controlled by a central processing unit and the motion is precisely transferred to the ram.

The vertical positioning of ram 24, or movement on the "Y axis," is affected by stepper motor 50 which is mounted on upright member 60. Stepper motor 50 drives gear 52 mounted on axle 54 which causes drive sprockets positioned on opposite ends to rotate. Axel 54 is journaled between opposite sides of upright members 60 and 61. As seen in FIG. 2 the drive belts for movement of the ram in a vertical direction are oriented along the interior sides the upright members. Activation of motor 50 causes belt 56 to rotate gear 52 which in turn rotates axle 54. Axil 54 drives sprocket 58 at the base of upright member 60 and causes drive belt 64 to move around its idler sprocket 68. Transverse member 40 is directly attached to one side of the drive belt 64 and resulting in the movement of the drive belt to be translated to transverse member 40. Transverse member 70 is provided to stabilize the upright members 60 and 61 and maintain them in a parallel orientation.

A third stepper motor 72, attached to the platform 74, drives ram 24 toward the target array 14, or along the "Z axis." Movement of stepper motor 72 is translated to belt 76 which drives axle 78 by way of gear 80. Axel 78 is journaled between horizontal track 82 and horizontal track 84 and has opposite drive sprockets on its ends. Drive sprocket 89 engages endless belt 90 which rotates around idler sprocket 97. Upright member 60 is secured to endless belt 90 at a location on the top side of the loop and is therefore moved as the belt moves. Upright member 60 has guide holes 105 and 106 to receive guide rod 101 of track member 82 to stabilize and guide the upright member toward the target array. The activation of stepper motor 72 may be controlled by the operator during a predetermined time interval by activation of drive actuator 26. The time interval when the drive actuator may initiate movement of the motor 72 is controlled by the CPU and, after a predetermined time interval has elapsed, the CPU will deactivate the operator's ability to control stepper motors 42 and 50 and then will automatically activate stepper motor 72. In the preferred embodiment stepper motor 42 and stepper motor 50 are not operated simultaneously and thus none of the stepper motors run at the same time.

FIG. 2 also depict the optional feature of the device which allows the ram to engage a series of switches 28 placed on the target array which correspond to ticket values. The sizes of the annular openings surrounding each respective ticket switch is different and will correspond to different values of tickets which are dispensed by the ticket dispenser by successfully aligning the ram opposite the respective opening containing the switch and allowing the ram to activate the switch. These spring biased switches are closed by engagement of ram 24 which sends a signal to the CPU to distribute a number of tickets corresponding to the target value. When the ram engages the switch a stall sensor 230 will generate a signal that the steeper motor 72 has stopped forward progress and the CPU will reverse the current to the stepper motor to reverse the ram and retract the ram.

Figure 3:
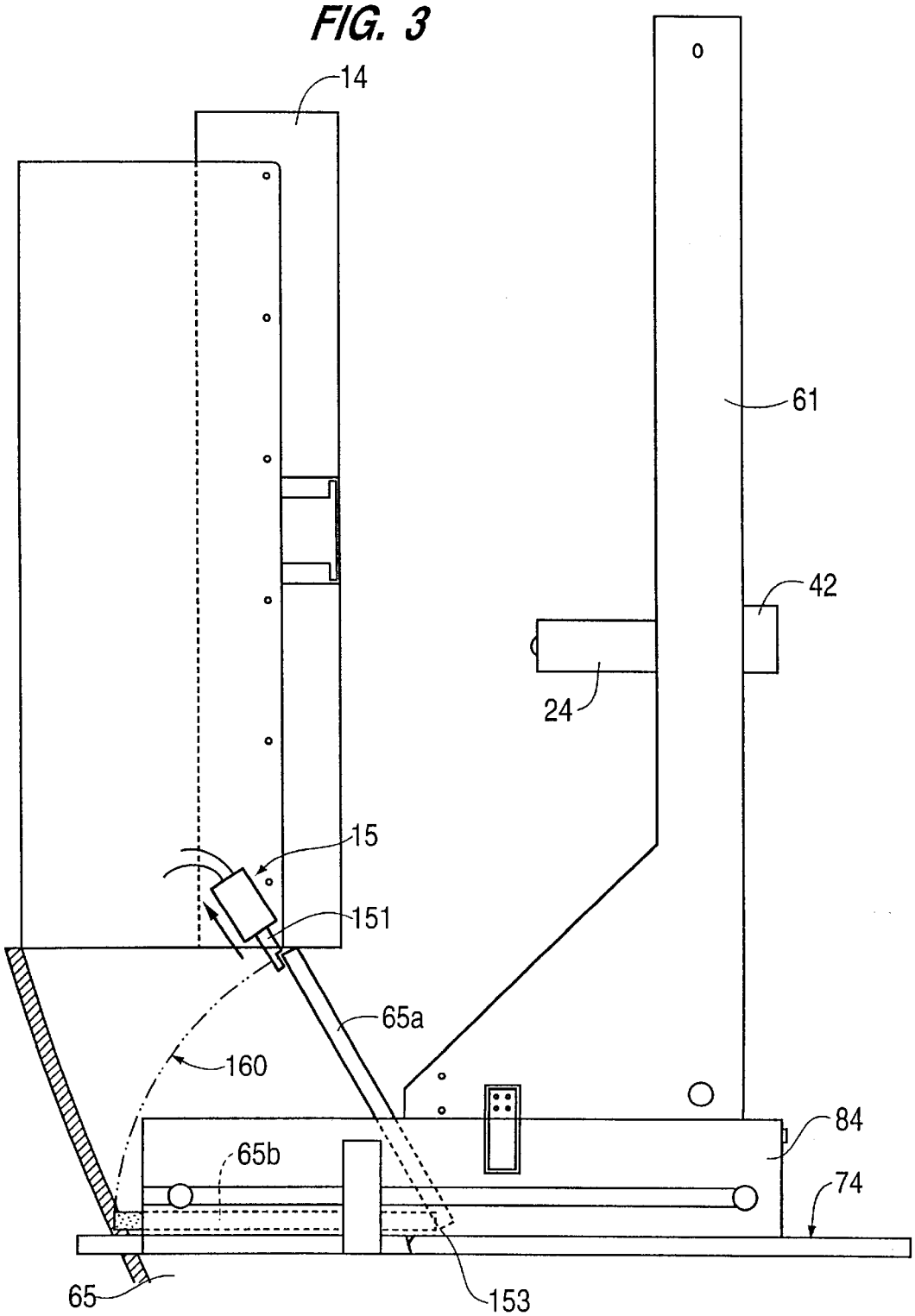
FIG. 3 is a side sectional view of the bottom portion of the device depicted in FIG. 1 showing the dispensing chute.

Now referring to FIG. 3, a side view of the device depicts an internal anti-tampering shutter 65*a* which is designed to frustrate tampering with the device such as by tilting the cabinet to cause items to fall out of the tubular members. Shutter 65*a* depicts the shutter in the open position or in the position which allows for fall from the target array 14 and through an opening in platform 74. Shutter 65 is controlled by a conventional tilt sensor which provides a signal to solenoid 15 in the event that the cabinet is tilted beyond a predetermined angle. If the threshold angle is met, a signal generated from the sensor activates tilt solenoid 15 which causes a central member 151 to retract and release its engagement with shutter 65. The release of shutter 65, which is attached to platform 74 by a conventional hinge 153, causes it to fall along arc 160 and close access to chute 155. Shutter 65*b*, which depicts the shutter in the closed position, will retains any items falling out of the tubular members and prevents any items from entering the dispensing area 30. Items which may fall out of the front of the tubular members fall onto platform 74 and cannot be accessed through dispensing area 30.

Figure 8:
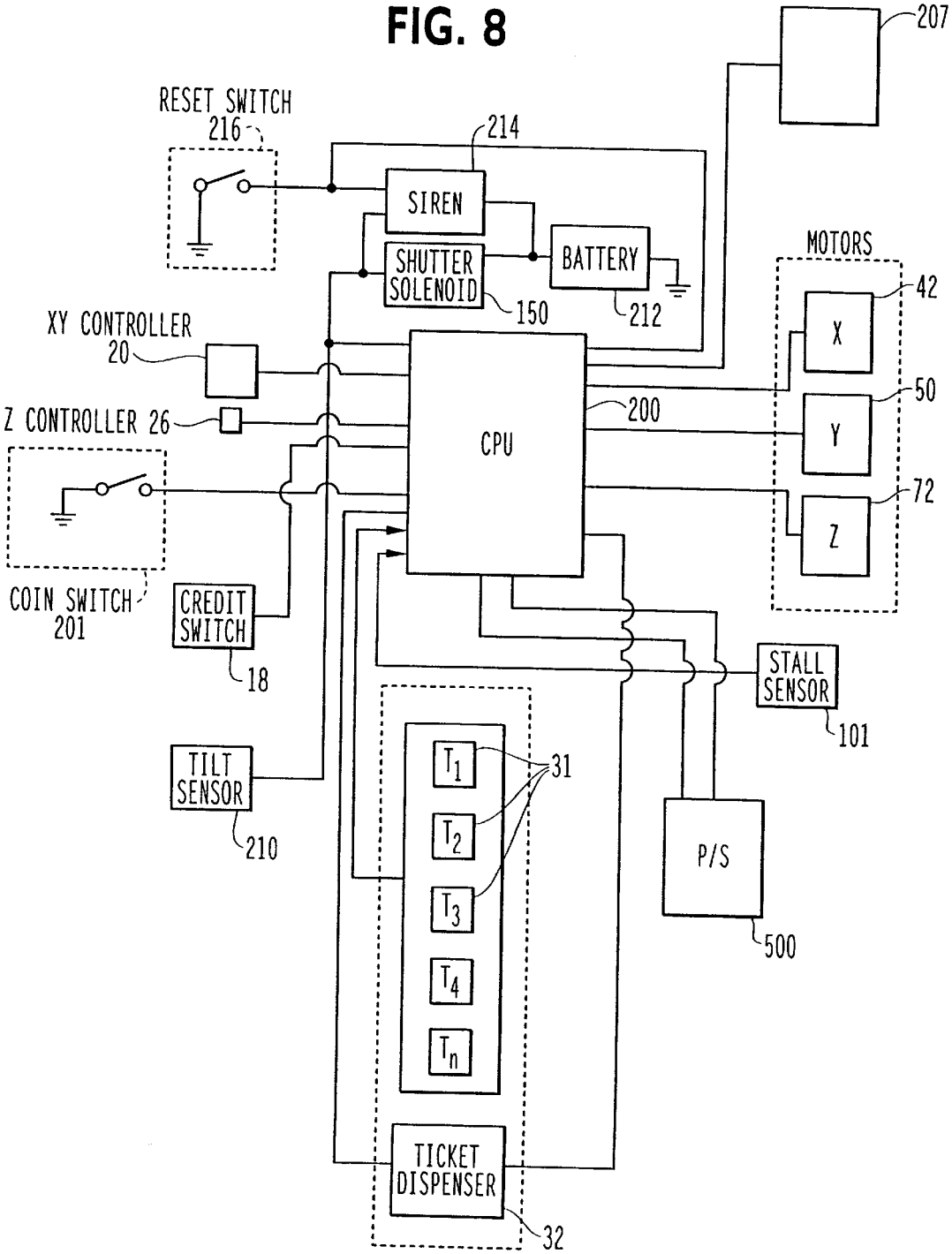
FIG. 8 is a schematic diagram of the electronic components of the first embodiment of the invention.

Now referring to FIG. 8, the elements which contribute to the anti-tampering control features include the tilt sensor 210, the shutter solenoid 150, battery 212, siren 214 and reset switch 218. In the event that the power source 500 of the device is removed, the anti tampering control elements will function because they operate by battery 212. A signal from tilt sensor 210 activates the shutter solenoid 150 and retracts member 151. The Tilt sensor also sends a signal to siren 214 and CPU which is programed to shut down further operation. Resetting the reset switch turns off the siren and sends a signal to the CPU allowing further operation of the game.

Figure 4:
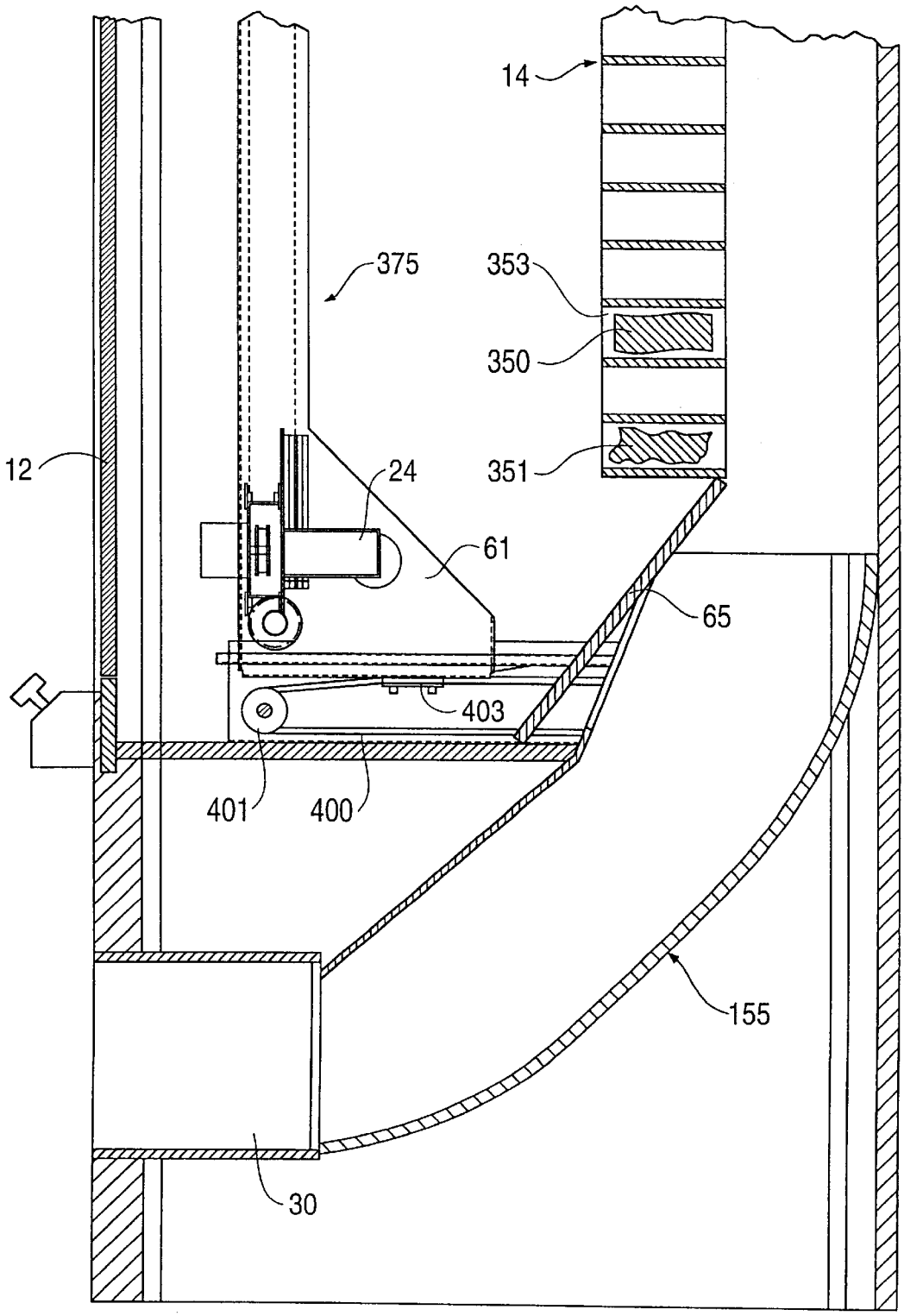
FIG. 4 is a side sectional view of the device depicted in FIG. 1 depicting the anti-tampering shutter and solenoid.

Referring now to FIG. 4, a sectional side view of the lower portion of the amusement device according to the first embodiment of the invention is shown. An item 350 may be displaced from its tube 353 and fall down the rear of the cabinet and hit canvass chute 155. Canvass chute 155 serves to break the fall of the displaced items and guides the items to dispensing area 30 located in the front of the cabinet where it can be accessed by the operator. The attachment of endless drive belt 400 to upright member 61 by clamp 403 is clearly illustrated in this view. The endless drive belt 400 works with endless drive belt 90 to drive the carriage assembly 275 toward target array 14. The carriage assembly 275 consists of the ram 24, bracket 49, the transverse member 40 and upright members 60 and 61, stabilizing member 70 along with the respective motors for movement of the ram on the XY grid.

Figure 5:
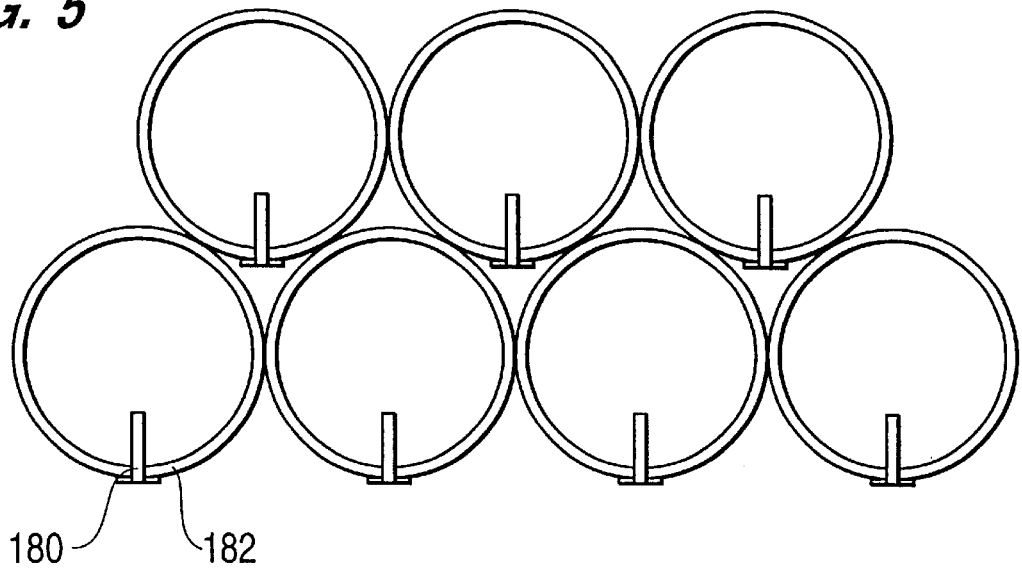
FIG. 5 is a rear view of a portion of a target array of tubular members which incorporate spring biased retention elements.
Figure 6:
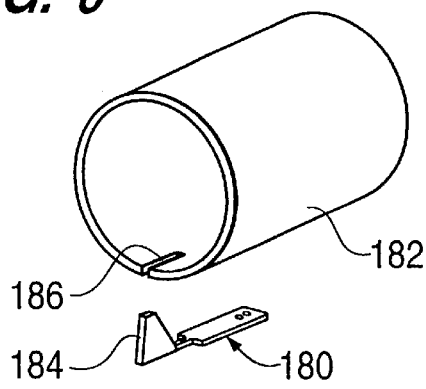
FIG. 6 is an exploded rear perspective view of a single tubular member which incorporates a spring biased retention element.
Figure 7:
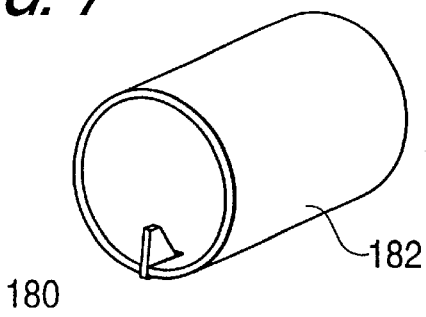
FIG. 7 is a rear perspective view of an assembly of a tubular member and its spring-biased retention element.

FIG. 5 depicts a further feature of the invention designed to prevent items from falling out of the back of the tubular members in the event the cabinet is tilted. This feature can be either alone or in combination with the tilt sensor system and provide further advantages in other contemplated embodiments of the invention. The feature may be made visible from a side window of the cabinet which may serve to further deter tampering with the device. As best seen in FIG. 6, the rear of each tubular member in the array is provided with and "L shaped" spring loaded blocking member 180 which is attached to the exterior sidewall of a tube 180. The vertically oriented portion 184 of member 180 is inserted through slot 186 and extends radially across the rear opening of the tubular member. The vertical extension 184 serves to retain an item within the tube and is designed to flex downward and outside of the cylindrical region defined by the tube in response to pressure exerted upon it from an item in the tube. As the ram engages and item in the tube, the item exerts a force on extension 184 and displaces the extension out of the tube allowing the item to pass out the rear. The force required to displace the member is designed to be sufficient to prevent an item from falling out of the tube in response to the machine being tilted. FIG. 7 shows the assembly of a single tubular member and spring loaded blocking member.

In addition to preventing items from falling out of the tubes when the device has been tilted, this feature allows for the orientation of the array target tubes in directions other than vertical arraignments. For example, using a spring blocking member, the target array could be conceivably be oriented in a horizontal plane and ram could engage the target array from the top of the cabinet. In this contemplated embodiment, the blocking member or members are designed to hold the weight of an item. If the item is engaged by a ram, it overcomes the force holding the item in place and the item is displaced downward to a dispensing area. It is further contemplated that other blocking members may be employed to function is a similar way such as flexible strips attached to the edges of the tube members which may be displaced outwardly in response to the pressure from the ram and prize. The number and type of blocking members optimally required to retain items within the tubes may be engineered depending on the desired angle of the target array and the respective weight of the items to be dispensed. A further advantage afforded by the array of tubular members is the ability to display and dispense a wide variety of prizes which were not compatible with cranes or which required special packaging.

Referring back now to FIG. 8, the operation of the amusement game embodiment as described above, is initiated by the detection of a coin by the coin detector 201. Coin detector 201 sends a signal to a central processing unit ("CPU") 200 which accesses a register to determine if there is sufficient value to activate the credit switch 18. If the predetermined credit value has been met, the CPU activates the credit switch 18. The closing of credit switch 18 by the operator sends a signal to CPU 200 which then enables XY controller 20 and initiates a timer internal to CPU 200 for a predetermined time. An output 207 containing both audio output and a visual output relating to the countdown is also activated by the CPU. The visual display is located at panel 208 on transverse member 40. In response to input from XY controller 20, CPU 200 provides pulse outputs to either X stepper motor 42 or Y stepper motor 50. The stepper motors 42 and 50 may be operated in either a forward or reverse direction depending on the input provided by the operator. Each pulse advances the stepper motor a discrete distance and the information relating to the number of pulses transmitted from the CPU 200 is counted by CPU 200 thereby providing the CPU information relating to the precise location of the ram. The operator thus provides input to the stepper motors to move ram 24 to a selected position in a plane defined by the X and Y axis' opposite a selected target contained within the target array 14. In addition to an XY controller 20 which is configured as a joystick in the embodiment depicted in FIG. 1, other input devices may be used to provide input for the X and Y motors to the CPU including arrangements such as four independent buttons representing four directional vectors or a rolling ball and sensor devices. When the operator is satisfied with the selected grid coordinate, a third input switch, Z controller 26, may be engaged to activate the Z stepper motor 70. Z stepper motor 70 drives the ram 24 forward by moving the entire framework or carriage assembly 275 consisting of, inter alia the ram 24, transverse member 40 and upright members 60 and 61 toward the target array. Activation of credit button 18 also sends a signal directly to the CPU controlling a timer which allows for activation of the XY controller 20 for a limited time interval. In the event the operator does not initiate movement of the ram 25 before the predetermined time interval has elapsed, the CPU 200 de-energized the XY controller and automatically activates Z motor 70 causing the assembly 275 ram 24 to move forward. When Z motor 70 is activated, the timer is interrupted and both the X and Y motors are deactivated so the operator can no longer can provide input to drive the ram on the XY grid. Forward progress of the ram 24 continues until either (1) ram 24 enters one of the target tubes reflecting a successful alignment, and a predetermined maximum distance is traveled, or (2) the ram engages the end wall of a tubular member reflecting a miss, or (3) the ram engages a target switch from array 28. If the operator has successfully aligned the ram with a tubular member, the Z motor 70 will cause ram 24 to move forward and into the tubular member. The leading edge of ram will engage any item contained within the tube and exert a force upon it pushing it rearward. Ram 24 will continue its progress through the tube a maximum predetermined distance which is sufficient to push an items contained within the tube out of the rear. The Z stepper motor 70 is next reversed to retract the ram to the grid position selected by the operator. The Y and X motors are then sequentially activated to return the ram to a home position.

Traversing the array is a horizontally displaced row of targets 28 consisting of a number of spring biased switches 31. Successfully aligning the ram so that it engages a switch 31 results in the generation of a signal which is transmitted to CPU 200 which then activates ticket dispenser 32 to distribute a number of tickets corresponding to the value of the target switch. Each of the target switches is centered within an annular opening having a radius which differs depending on the value of the target. For example, in the embodiment depicted in FIG. 2 the annular opening of the center target has a value of 500 and has a smaller radius than the adjacent target having a value of 250.

In the event the ram is not directly aligned with a tubular member, the leading edge of the ram will engage the annular end walls of a tube or a switch and stall. When the Z motor is stopped or stalled by the engagement with the annular end walls or a switch, a signal is generated by a photoelectric stall sensor 230 which detects the movement of carriage assembly 275 along the Z axis. Stall sensor 230 is made up of stationary infrared light source opposite a photo detector. A stall shutter 231 mounted on upright member 61 and oriented to pass between the light source and the photo detector moves into the stall sensor as the carriage assembly 275 moves toward the target array. As the carriage assembly 275 moves toward the target array, stall shutter 231 interrupts the path of light between the light source and the photo detector which results in a signal to CPU 200. CPU 200 then seeks a second signal from the photo detector which indicates that the shutter has passed the detector. If the device is stalled, no signal is generated by the stall sensor 230 within a predetermined time and CPU 200 sends a signal to Z motor 70 to reverse. Thus, CPU 200 interprets the lack of a second signal from the stall sensor that the ram has stalled and sends a signal to retract the ram to the grid coordinate selected by the operator. The CPU then sequentially actives the X and Y stepper motors to return the ram to the home position. The home position is typically located at a location outside the periphery of the target area. It is contemplated that other stall sensors would be effective in the invention such as by the use of light sources and detectors which reflected light off carriage assembly 275 or by the measurement of the voltage driving Z motor.

The operation of the game is controlled by CPU 200 which has a multitask operating system so that the can perform a number of tasks simultaneously. Upon the introduction of a coin or token into a conventional coin acceptor slot 16, a coin acceptor 201 determines if the coin is genuine and either rejects the coin and returns the coin to the coin return 17 or accepts the coin and sends a signal to CPU 200. When the predetermined monetary value for operation of the device has been met, credit switch 18 is activated by the CPU. Upon activation of credit switch 18 by the operator, the XY controller 20 for X stepper motor 42 and Y stepper motor Y 50 is activated. An internal timer contained within CPU 200 is also activated by the credit switch which counts down a predetermined time when the XY controller 20 is activated. Input from the XY controller to the CPU is processed and converted to output for X stepper motor 42 and Y stepper motor 50 causing ram 24 to move on the XY grid. After the predetermined time has elapsed, or, upon engagement of the Z controller 26, Z motor 70 is activated which drives the ram toward the target array.

Although in the preferred embodiment the motion of the ram in the Z direction is affected by a Z stepper motor 70 that moves the entire assembly 275 forward including the upright members and transverse members, it is contemplated that a motor could be mounted on the bracket 49 adjacent to the ram to move the ram forward in a rectilinear direction. For example a motor and screw gear arrangement could advance a telescopic ram assembly toward the target array rather than moving the entire carriage assembly 275 as described above. It is also contemplated that the horizontal and vertical drivers could be arranged so that the vertical motion is achieved by the provision of a motor on a single vertical member attached to a pair of opposite transverse members located near the top and bottom of the target array. Movement on the Z axis may also be affected by tracks on the lateral side or on the top of the device rather than at the bottom. For example, the device as disclosed in FIG. 2 could be rotated ninety degrees and still function according to the concepts of the invention. In yet a further contemplated embodiment, a motor may be provided in association with the ram to rotate the cylindrical exterior wall of the ram to achieve a visual effect resembling a drill.

Although in the preferred embodiment the targets are defined by tubular members having annular end walls and the ram is cylindrical, it is contemplated that other shapes could be used for both the ram and the tubular cavities such as squares, triangles or combinations thereof. It is further contemplated that sizes of the tubular members may be selected to have a variety of different dimensions to provide different degrees of difficulty to the operator.

Figure 9:
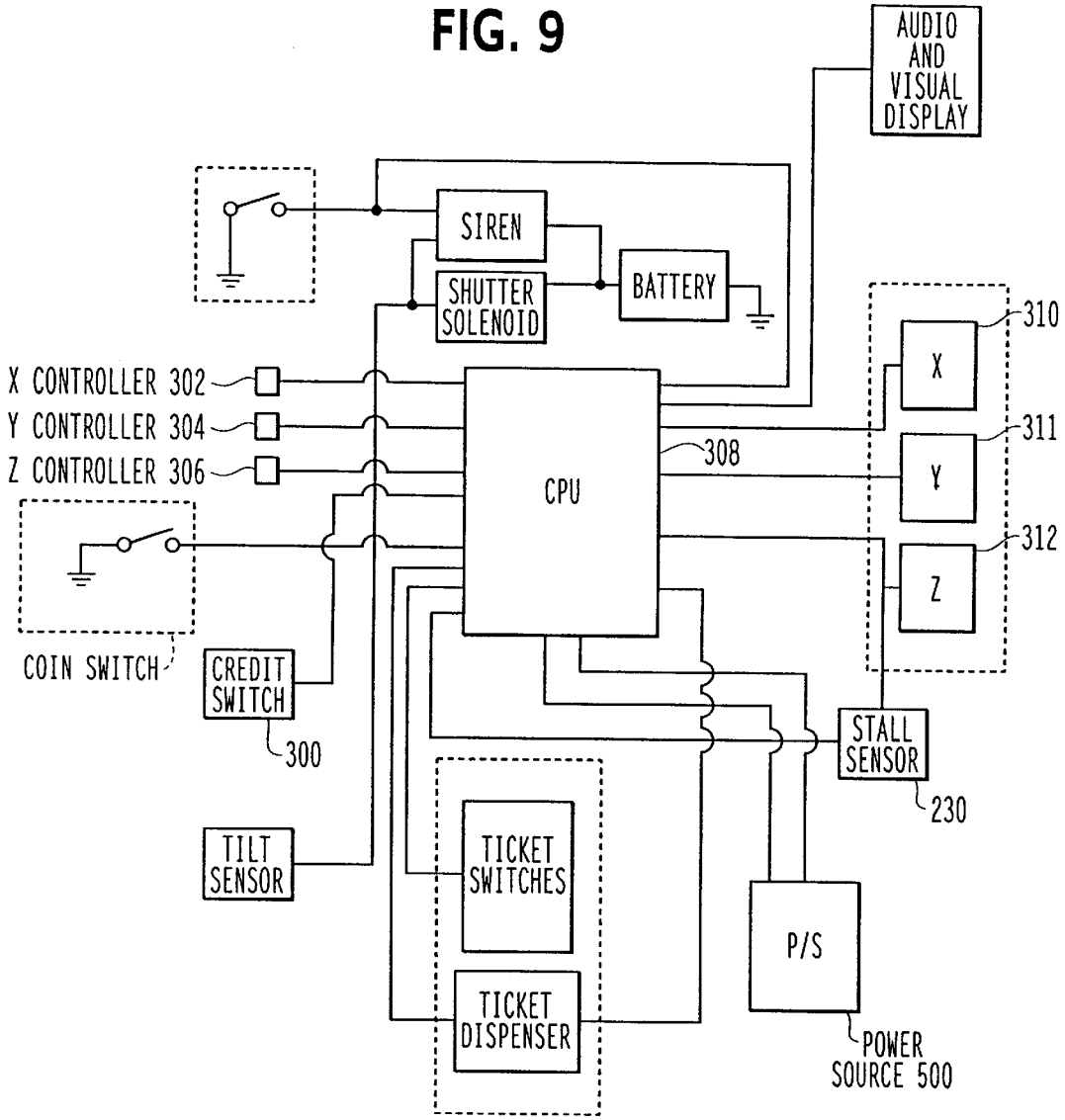
FIG. 9 is a schematic diagram of the electronic components of a second embodiment of the invention.

An alternative embodiment of the invention also configured for use as an amusement game is depicted in FIG. 9 which provides separate controllers for the X and Y motors. In this embodiment, credit switch 300 causes CPU 308 to first activates independent X controller 302 for a predetermined time. The input is accepted from the controller and provided as input to CPU 308 which drives stepper motor 310 in forward or reverse to cause ram to move to the left or right direction for a predetermined time. At the end of the time interval, the X controller 302 is deactivated and Y controller 304 is activated for a second predetermined time interval monitored by the CPU 308. The operator can provide input to CPU 308 which relates the vertical travel of the ram on the Y axis. After the time interval for the Y controller has elapsed, or upon of engagement of Z actuator 306, the Z motor 311 is energized. Audio and visual outputs are controlled by the CPU to display the operator a signal reflecting which controller is presently operable, such as a blinking light, and information relating to the time period of the activation such as a countdown on a LED display and an audio signal is also provided.

In yet a further alternative contemplated embodiment, the selection of the location of the ram on the XY grid involves a skill stop operation. Again referring to FIG. 9, in the skill stop embodiment, the X controller 302 and the Y controller 304 are programmed to stop operation of the respective stepper motors 310 and 311. In this embodiment, activation of the credit switch 300 causes the X stepper motor 310 to energize and slowly drive the ram in one direction along the X axis of the grid until a player hits X controller 302 which sends a signal to the CPU 308 to de-energize stepper motor 310. Next CPU 308 sends a signal to energize Y stepper motor 311 which slowly drives the ram in a vertical direction until the operator hits Y controller 304. Engagement of the Y controller 304 sends a signal to the CPU to deactivate the Y stepper motor 311. In this embodiment the X and Y controllers function as controls to stop or de-energize the stepper motors which results in positioning of the ram in a selected grid position. CPU 308 then provides a signal to Z motor 312 which drives the ram toward the target array.

Figure 10:
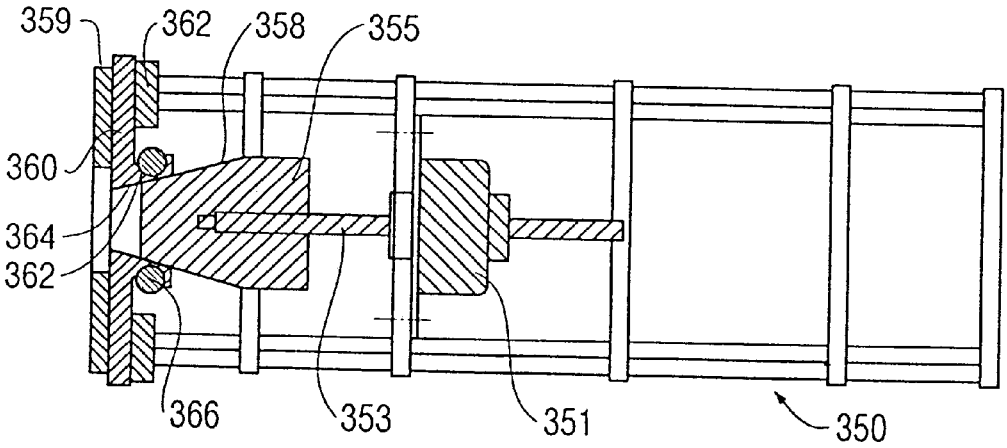
FIG. 10 is a side sectional view of an alternative embodiment of a ram which can be used in connection with the invention.

FIG. 10 depicts an alternative embodiment of a ram 350 which incorporates stepper motor 351 and a piston 353 which drives cone shaped head 355. The sloped surface 358 of the head 355 engages a plurality of radial ribs 359 which are retained on the rear surface of annular ring 360. Ribs 359 are retained in annular retention elements 362 positioned around the circumference of the annular ring 360 which allow for the radial movement of the ribs with respect to the central axis of the ram. The ribs 359 have an extension 363 extending in the axial direction with respect to the ram which has a bottom surface 364 with a slope complementary to that of surface 358 of the head 355. The ribs are biased toward the central axis of the ram and against the head of the ram by annular spring 362.

Figure 11:
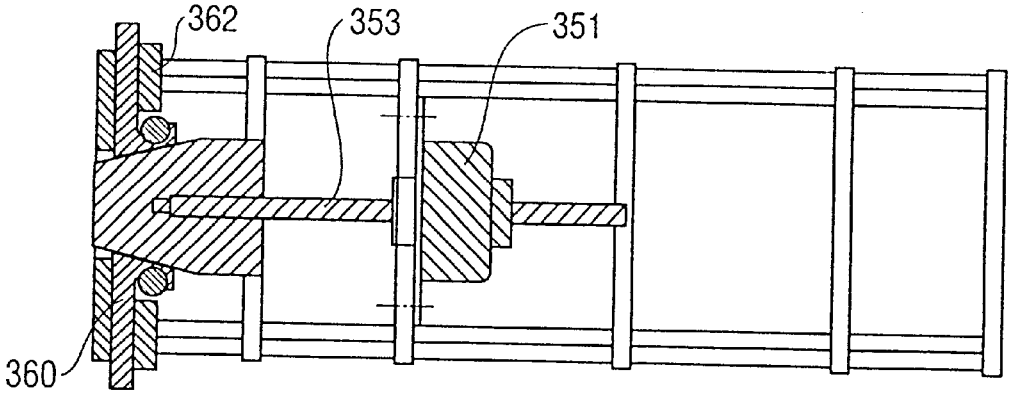
FIG. 11 is a side sectional view of an alternative embodiment of a ram of FIG. 10 depicting the radial ribs in an extended position.
Figure 12:
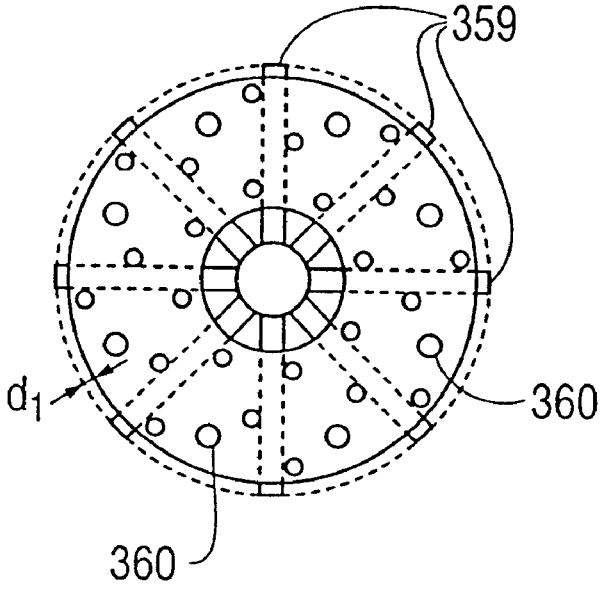
FIG. 12 a front axial view of the ram depicted in FIG. 10.
Figure 13:
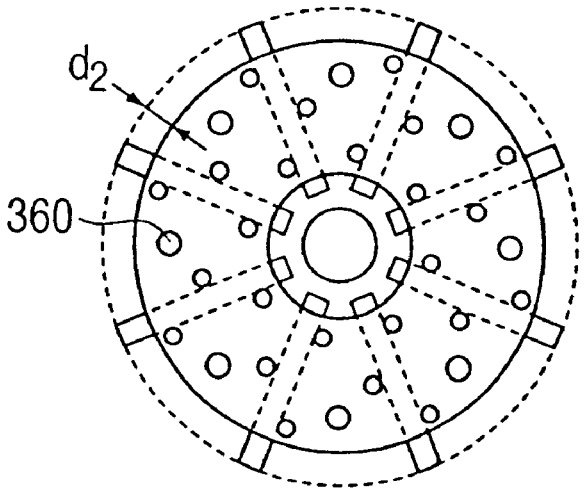
FIG. 13 is a front axial view of the ram of FIG. 10 with the ribs in an extended position.

As shown in FIG. 11, as head 355 moves toward annular ring 360 the lateral extension 364 of the ribs ride up along the head and cause the ribs to extend radially outward—effectively increasing the maximum diameter of the ram. As best seen in FIGS. 11 and 12, the ribs 359 increase from a distance d1 shown in FIG. 11 reflecting a distance from the circumference of annular ring 350 to the end of the rib to distance d2 shown in FIG.12 reflecting a second distance, greater than d1, from the circumference of annular ring 350 to the end of the of the rib. When the head retracts back toward stepper motor 351, spring 366 causes the ribs to retract toward the central axis diminishing the effective diameter of the ram. In the preferred embodiment the stepper motor has a total of 500 steps which are controlled by a central processing unit and allows for travel of the arbor or head 355 a total distance of 0.5 inches. In the embodiment depicted in FIGS. 10–13 the effective diameter of the ram head is increased from 2.47 inches to 2.75 inches. The distance that stepper motor 351 is advanced is programmed and controlled by the CPU and can depending on the location of the ram with respect to the XY grid. Accordingly the CPU accesses information relating to the location of the X stepper motor and the Y stepper motor and then looks up a value for stepper motor 351, a signal is then transmitted to stepper motor 351 to correspond to the value. The incorporation of this feature allows the owner of the machine to program the degree of difficulty for each tube location and yet maintain all the tubular members the same size. Thus, depending on the respective value of the prize contained within a tube, the diameter of the ram can be altered.

Figure 14:
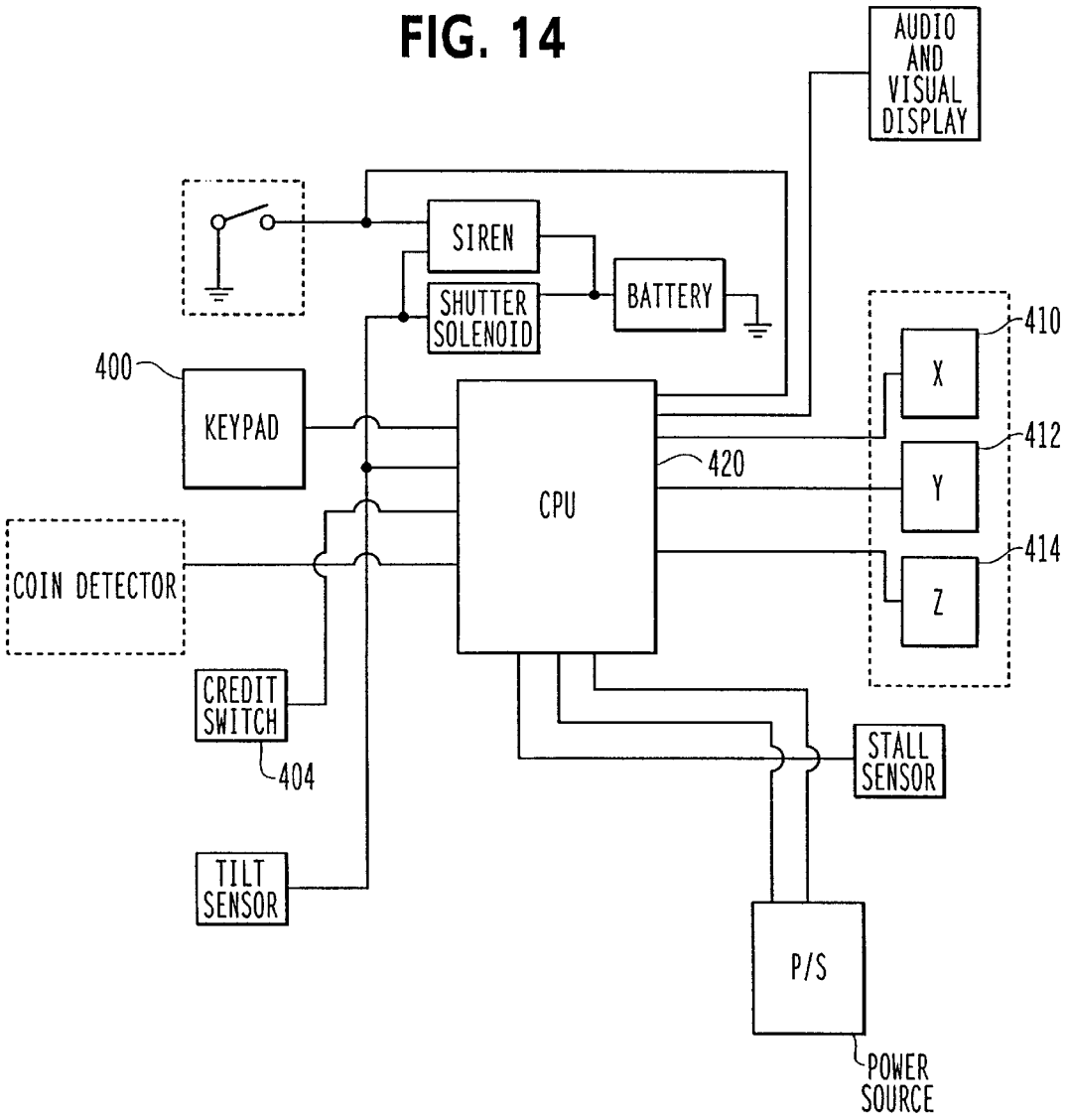
FIG. 14 is a schematic diagram of an alternative embodiment of the invention.

The invention can also be adapted to friction as a vending machine by substituting the control element of the game device with a keypad or keyboard which provides for the entry of precise coordinates relating to the location each tubular members in the target array. Now referring to FIG. 14, the keypad 400 has alphanumeric keys which provide input to the CPU 4200 which corresponds to unique alphanumeric codes associated with each of the tubular members in a target array. After the a predetermined monetary has been inserted into the coin detector 402, CPU 420 activates credit switch 404 which energizes the keypad 400. The operator can then enter a code corresponding to the item selected from the tubular arrays and a signal is sent to CPU 420. CPU 420 then provides an output in the form of a visual display corresponding to the code selected by the operator and looks up the value for the selected tubular member. CPU 420 proceeds to sequentially engage the X stepper motor 410, the Y stepper motor 412 to precisely align the ram opposite the selected target tube and then engages Z stepper motor 414 to drive the ram forward and into the tubular member. The sequence is then reversed and the ram is returned to a home position. CPU 420 can activate each stepper motor a precise distance and therefore can oriented the ram precisely opposite the selected target before the Z motor is activated. The engagement of the item contained within the tube by the ram is analogous to the other embodiments recited herein. Each of the tubular members are labeled according to an alphanumeric code and may be provided with other written information relating to the item contained within the tubular member.

It will be apparent to those skilled in the art and it is contemplated that variations and/or changes in the embodiments illustrated and described herein may be made without departure from the present invention. Accordingly, it is intended that the foregoing description is illustrative only, not limiting, and that the true spirit and scope of the present invention will be determined by the appended claims.

What is claimed is:

1. A coin operated device for the distribution of items comprising:

a target array;

a ram attached to and extending from a support member, said support member providing for movement of said ram within a plane located outside said target array;

first means to move said ram in said plane and second means to move said ram in a direction perpendicular to said plane and toward said target array to apply a driving force to said ram in a linear direction perpendicular and away from said plane; and a control system for the alignment of said ram in said plane opposite said target array;

a control system for the alignment of said ram in said plane opposite said target array and said target array further comprises:

tubular members having front openings;

rear openings; and a radial dimension and said ram has a radial dimension smaller than said radial dimension of said tubular members which enables said ram to be received within said tubular and to exert a driving force on objects contained within said tubular members.

2. The device as recited in claim 1 wherein said openings of said tubular members define a plane oriented in a vertical direction.

3. The device as recited in claim 1 wherein the said tubular members comprise:

members having different radial dimensions.

4. The device as recited in claim 1, further comprising:

a timer, wherein said timer controls a predetermined time interval when said input to said motors may be provided by said operator to orient said ram in said plane opposite said target array.

5. The device as recited in claim 1 wherein said tubular members further comprise:

a front opening;

a rear opening; and retention means to retain an item from exiting said rear opening unless a predetermined force is applied to said item.

6. The device as recited in claim 5 wherein said retention means comprises a spring biased member.

7. The device as recited in claim 5 wherein said retention means comprises a frictional force between said item and said tubular member.

8. The device as recited in claim 1 wherein said tubular members are cylindrical and an axial section of said head of said ram is circular.

9. A coin operated device for the distribution of items comprising:

a target array;

a ram attached to and extending from a support member, said support member providing for movement of said ram within a plane located outside said target array;

first means to move said ram in said plane and second means to move said ram in a direction perpendicular to said plane and toward said target array to apply a driving force to said ram in a linear direction perpendicular and away from said plane; and a control system for the alignment of said ram in said plane opposite said target array;

a control system for the alignment of said ram in said plane opposite said target array and said target array further comprises:

pressure activated switches wherein said ram engages said pressure activated switches.

10. A coin operated device comprising a ram and a plurality of targets, a first motor to move said ram in a first linear direction, a second motor to move said ram in a second linear direction, said second linear direction perpendicular to said first linear direction, said first and second linear directions forming a planar grid, and a third motor to move said ram in a third linear direction perpendicular to said planar grid, a controller to control the movement of said first and said second motor, said targets surrounded by annular end walls and said ram having a radial dimension less than the radial dimension of said annular end walls, wherein said controller is responsive to input by an operator and can be positioned in a selected location in said planar grid.

11. The device as recited in claim 10 wherein said ram further comprises means to alter the radial dimension of said ram.

12. The device as recited in claim 10 further comprising a plurality of spring biased ribs extending in a radial direction from an axis defined by said ram, a head which engages said ribs, and a motor for driving said head in an axial direction, wherein said axial motion of said head is translated to said ribs causing said ribs to move in a radial direction.

13. The device as recited in claim 6 wherein said control means to alter said radial dimension is controlled by said central processing unit and the extent of said movement in said dimension is dependant on the location of said in said ram with respect to said planar grid.

14. The skill amusement device recited in claim 10 further comprising endless drive belts.

15. The coin operated device for the distribution of items comprising a ram and a plurality of tubular members, a first motor to move said ram in a first linear direction, a second motor to move said ram in a second linear direction, said second linear direction perpendicular to said first linear direction, said first and second linear directions forming a planar grid, and a third motor to move said ram in a third linear direction perpendicular with said planar grid, a controller to control the movement of said first and said second motor, said tubular members having annular end walls and said ram having an axial dimension less than the axial dimension of said annular end walls, wherein said controller comprises a keypad responsive to input by an operator and said input corresponds to a plurality of preselected precise coordinates in planar grid each said coordinates corresponding to positions directly opposite said tubular members.

16. A coin actuated dispensing device comprising a plurality of tubular members defining an upright planar array, a ram secured to a first endless belt, said first endless drive train driven by a first motor to provide for movement of said ram in a first linear direction in a second plane parallel with said planar array, said ram said first endless belt and said first motor secured to a first member, said first member attached to a second endless drive train, said second endless drive train driven by a second motor to provide for movement of said member in a second linear direction in said second plane, said second endless belt and said motor secured to a second member, said second member attached a third endless drive train, said third endless drive train driven by a third motor to provide for linear movement of said ram, said first member and said in a third direction perpendicular to said second plane.

17. A coin actuated dispensing device comprising a plurality of tubular members defining an upright planar array, a ram, control means for moving said ram, means to move said said ram in a first linear direction in a second plane parallel with said planar array, means to move said ram in a second linear direction in said second plane, mean to move said ram in a third linear direction perpendicular with said second plane in a direction toward said upright planar array.

* * * * *